US007995782B2

(12) United States Patent
Saltykov

(10) Patent No.: US 7,995,782 B2
(45) Date of Patent: Aug. 9, 2011

(54) COMBINED RECEIVER AND EAR-CANAL MICROPHONE ASSEMBLY FOR A HEARING INSTRUMENT

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 1228 days.

(21) Appl. No.: 11/668,105

(22) Filed: Jan. 29, 2007

(65) Prior Publication Data

US 2008/0181440 A1 Jul. 31, 2008

(51) Int. Cl.
*H04R 25/00* (2006.01)

(52) U.S. Cl. ..... 381/328; 381/329

(58) Field of Classification Search ..... 381/328, 381/329
See application file for complete search history.

(56) References Cited

U.S. PATENT DOCUMENTS 3,763,333 A * 10/1973 Lichowsky ..... 381/318
5,033,090 A * 7/1991 Weinrich ..... 381/318
5,195,139 A * 3/1993 Gauthier ..... 381/322
5,201,006 A * 4/1993 Weinrich ..... 381/318

* cited by examiner

*Primary Examiner* — Fan Tsang
*Assistant Examiner* — Phylesha Dabney

(57) ABSTRACT

A sound tube having two passages affords a compact arrangement for a combined receiver and ear-canal microphone assembly. The ear-canal microphone is positioned in line with the receiver but above the receiver's output port, and the sound tube connects both with the ear canal.

6 Claims, 6 Drawing Sheets

COMBINED RECEIVER AND EAR-CANAL MICROPHONE ASSEMBLY FOR A HEARING INSTRUMENT

BACKGROUND AND SUMMARY OF THE INVENTION

When a hearing instrument is inserted in the ear canal, the canal may be "occluded," i.e., blocked. This may cause the user to experience a hollow sound when speaking, a phenomenon called the "occlusion effect." One solution is to provide a vent that allows the sound pressure that develops in the ear canal to escape.

The occlusion effect may also be addressed by using the resulting sound to electronically cancel or minimize its effect. An ear-canal microphone captures that sound in the occluded ear and the signal is provided to circuitry in the receiver that uses the ear-canal microphone signal to cancel the sound. (See, e.g., U.S. Pat. No. 6,937,738, issued on Aug. 30, 2005, for a "Digital Hearing Aid System," incorporated here by reference.)

DESCRIPTION OF THE INVENTION

Figure 1:
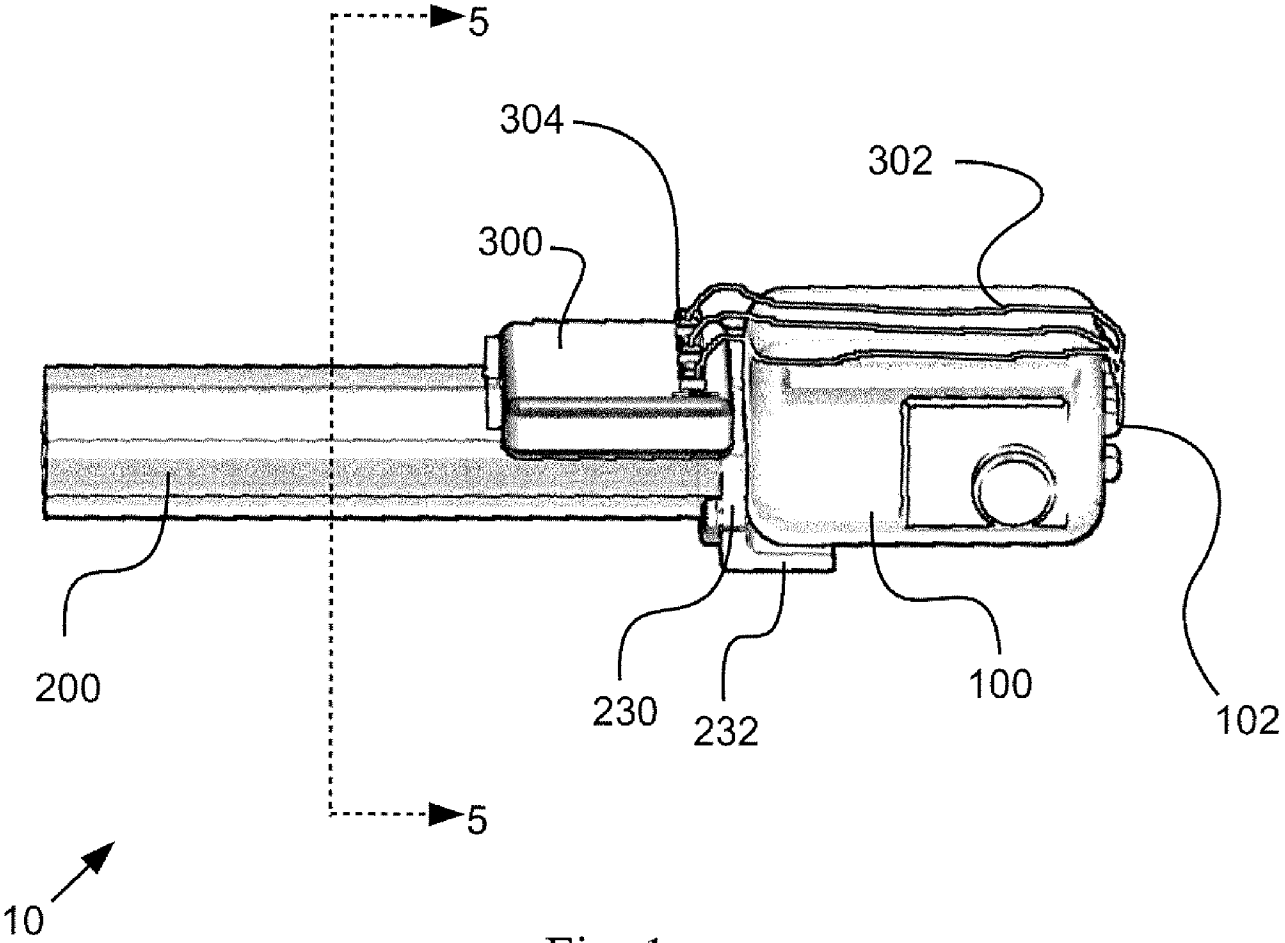
FIG. 1 is a drawing of a combination receiver and ear canal microphone with a sound tube having a passage for the ear canal microphone.

A combined receiver (100), sound tube (200), and ear-canal microphone (300) assembly 10 is illustrated in FIG. 1. Wiring 302 carries the output signal from terminals 304 of the ear-canal microphone 300 to terminals 102 on the receiver 100. The receiver 100 and the ear-canal microphone 300 are shown apart from the sound tube 200 in FIGS. 2 and 3, although the receiver 100 and the microphone 300 are positioned spatially with respect to each other as they are in the combined assembly of FIG. 1.

Figure 2:
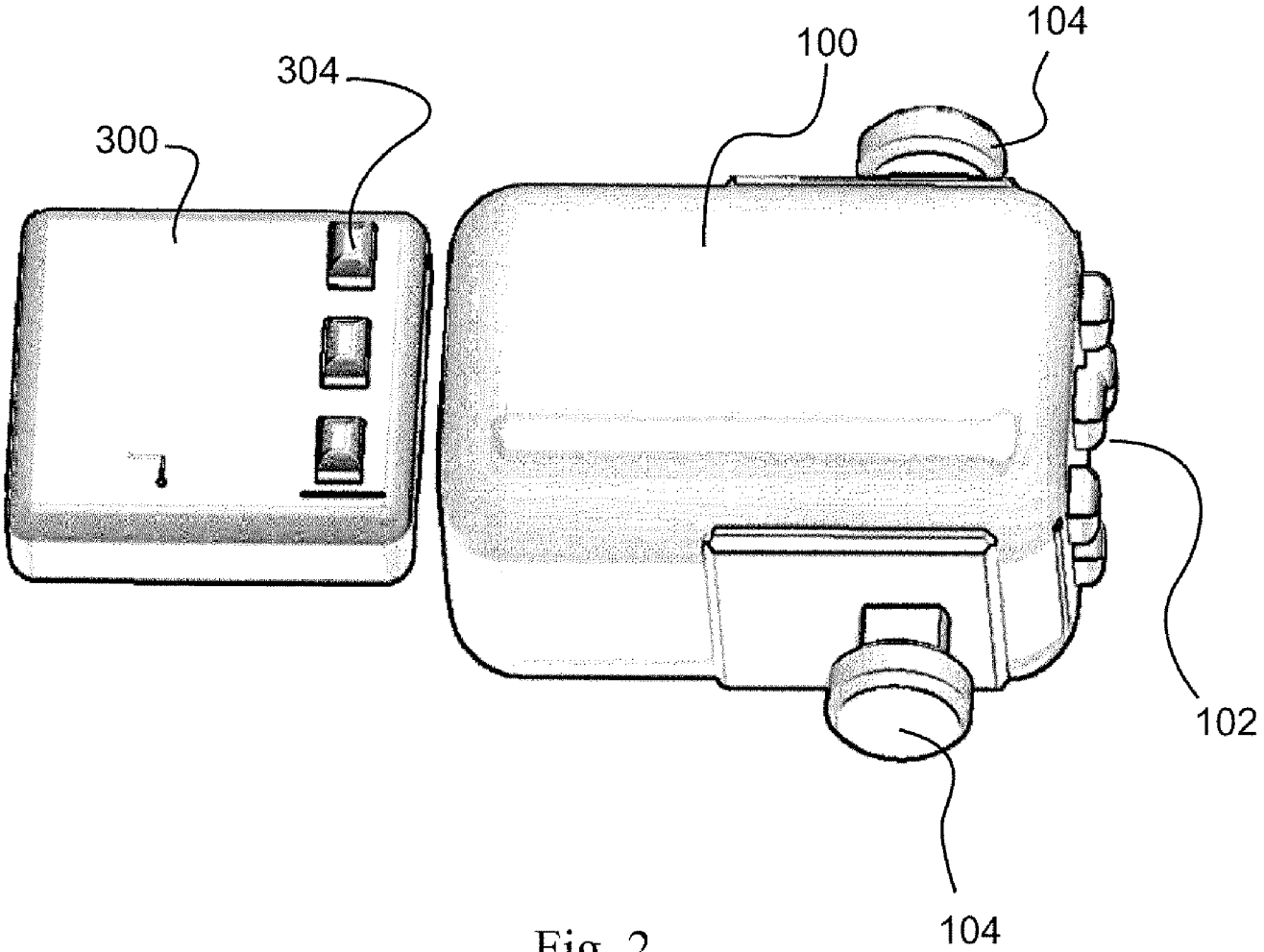
FIGS. 2 and 3 are drawings of the receiver and ear-canal microphone.
Figure 3:
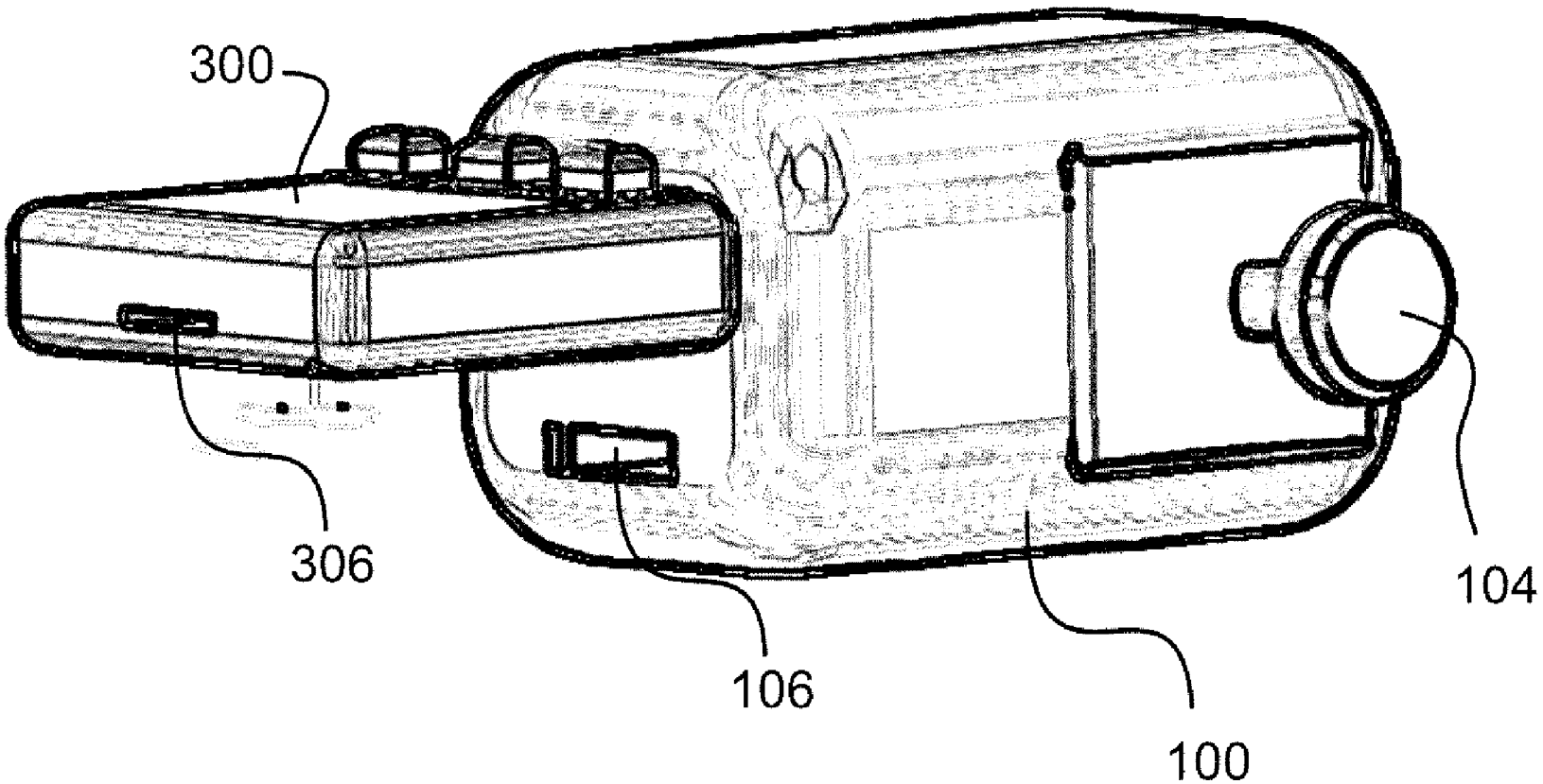

Mounting studs 104 for the receiver 100 are shown in FIGS. 2 and 3. These are described in U.S. Patent Application Publication No. 2005/074138, dated Apr. 7, 2005, incorporated by reference herein.

Both the receiver 100 and the ear-canal microphone 300 have sound ports. In FIG. 3, a receiver output port 106 is located on the receiver 100 under the ear-canal microphone 300 and the ear-canal microphone 300 has an ear-canal input port 306.

Figure 4:
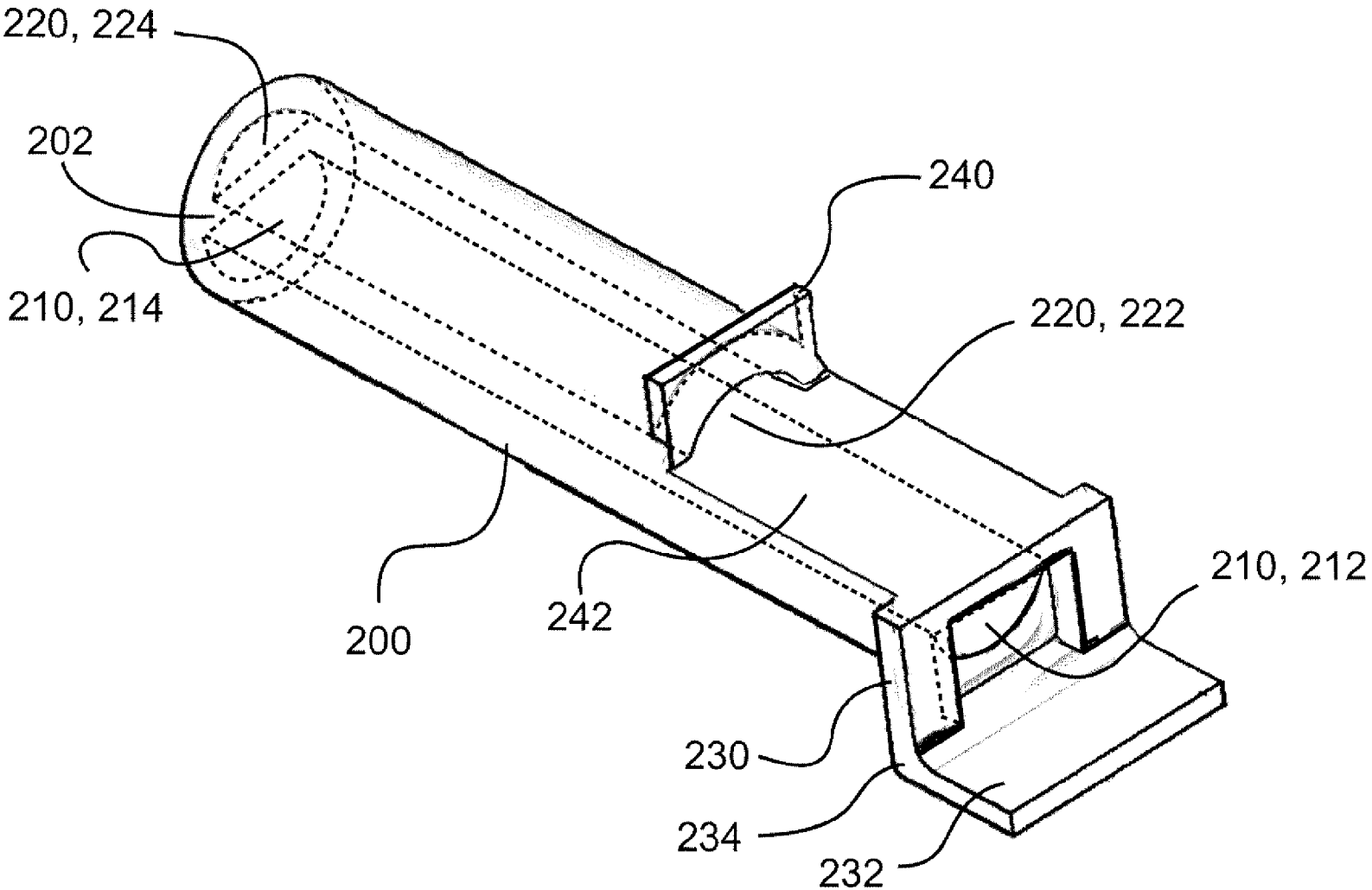
FIG. 4 is a drawing of a sound tube with an ear-canal microphone passage.

The sound tube 200 is shown separately in FIG. 4. The tube 200 may have a generally cylindrical cross-section subdivided by a divider 202 to provide a receiver passage 210 for the output of the receiver 100 and an ear-canal microphone passage 220 for the input to the ear-canal microphone 300. The receiver passage 210 also has a receiver aperture 212 at one end and a hearing instrument aperture 214 at the other end. Similarly, the ear-canal microphone passage 220 has an ear-canal microphone aperture 222 at one end and a hearing instrument aperture 224 at the other end. When the assembly 10 is positioned in the hearing instrument (FIG. 6), the apertures 214 and 224 connect passages 210 and 220, respectively, with the ear canal.

The sound tube 200 also has a receiver flange 230 and a receiver platform 232 extending outwardly from the receiver flange 230. Together, the receiver flange 230 and the platform 232 form a right-angle 234 and accept the receiver 100, providing a positive registration for the receiver 100 with the sound tube 200 as well as vertical alignment of the receiver output port 106 with the receiver aperture 212 of the receiver passage 210 (see these elements in FIG. 1, as well).

As shown in FIGS. 1-3, the receiver 100 and the ear-canal microphone 300 are generally adjacent and positioned in tandem, i.e., one behind the other. To accommodate the ear-canal microphone 300 with the receiver 100 positioned on the receiver flange 230, a portion of the sound tube 200 is cut back from the location of the receiver flange 230, yielding an ear-canal platform 242 above the receiver passage 210.

As further illustrated in FIG. 4, an ear-canal flange 240 is located at the edge of the cutaway portion (the ear-canal platform 242). The ear-canal platform 242 together with the ear-canal flange 240 provide a mounting location for the ear-canal microphone 300 as well as vertical alignment for the ear-canal input port 306 with the ear-canal aperture 222 of the ear-canal microphone passage 220

Figure 5:
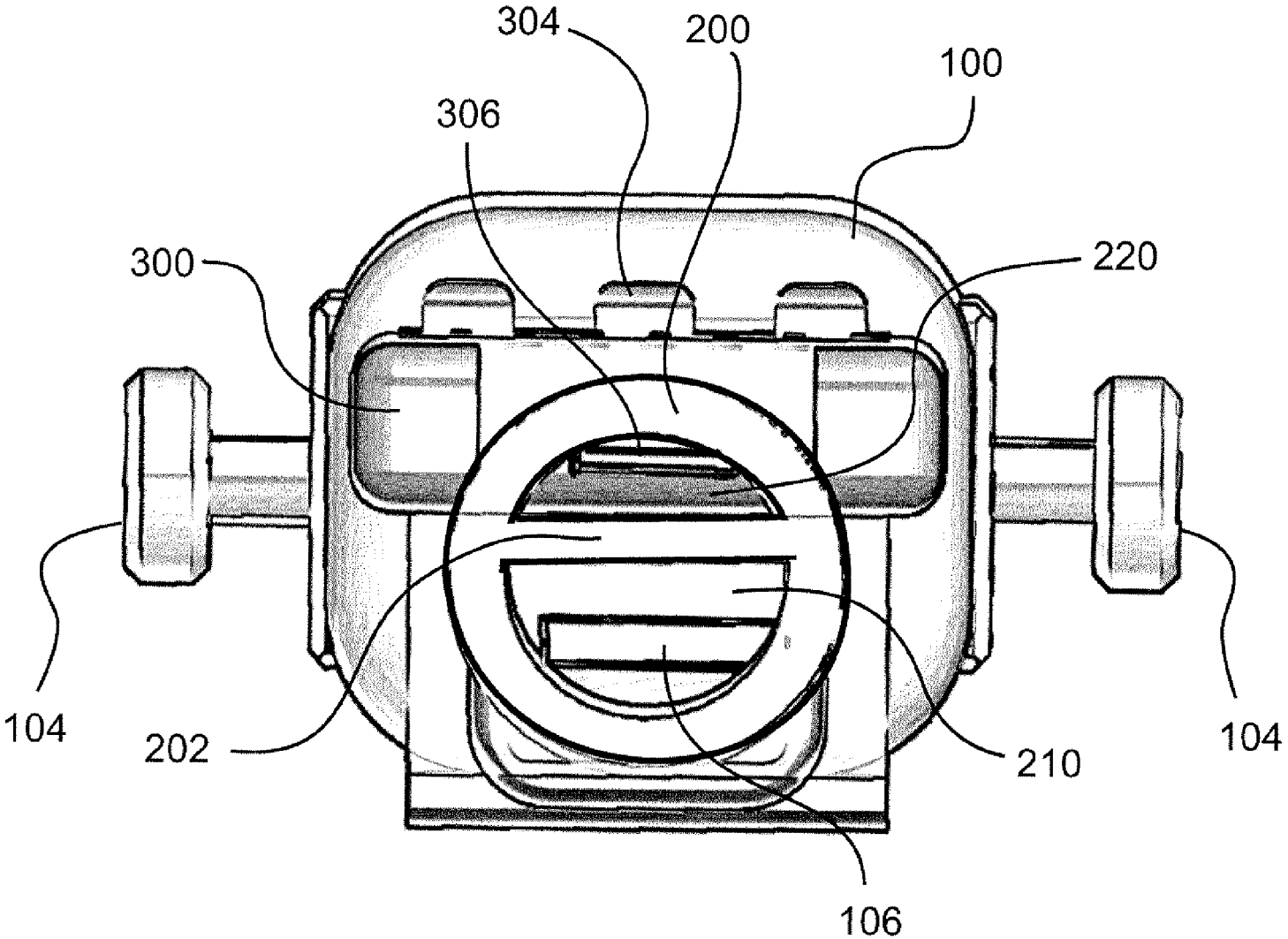
FIG. 5 is a sectional view of the assembly of FIG. 1.

The receiver 100, the ear-canal microphone 300, and a cross-section of the sound tube 200 are shown in FIG. 5, taken according to the section indicated in FIG. 1. Note the divider 202 separating the receiver passage 210 from the ear-canal microphone passage 220. As can be seen from FIGS. 4 and 5, the receiver passage 210 and the ear-canal microphone passage 220 are separate and therefore acoustically isolated from each other.

Figure 6:
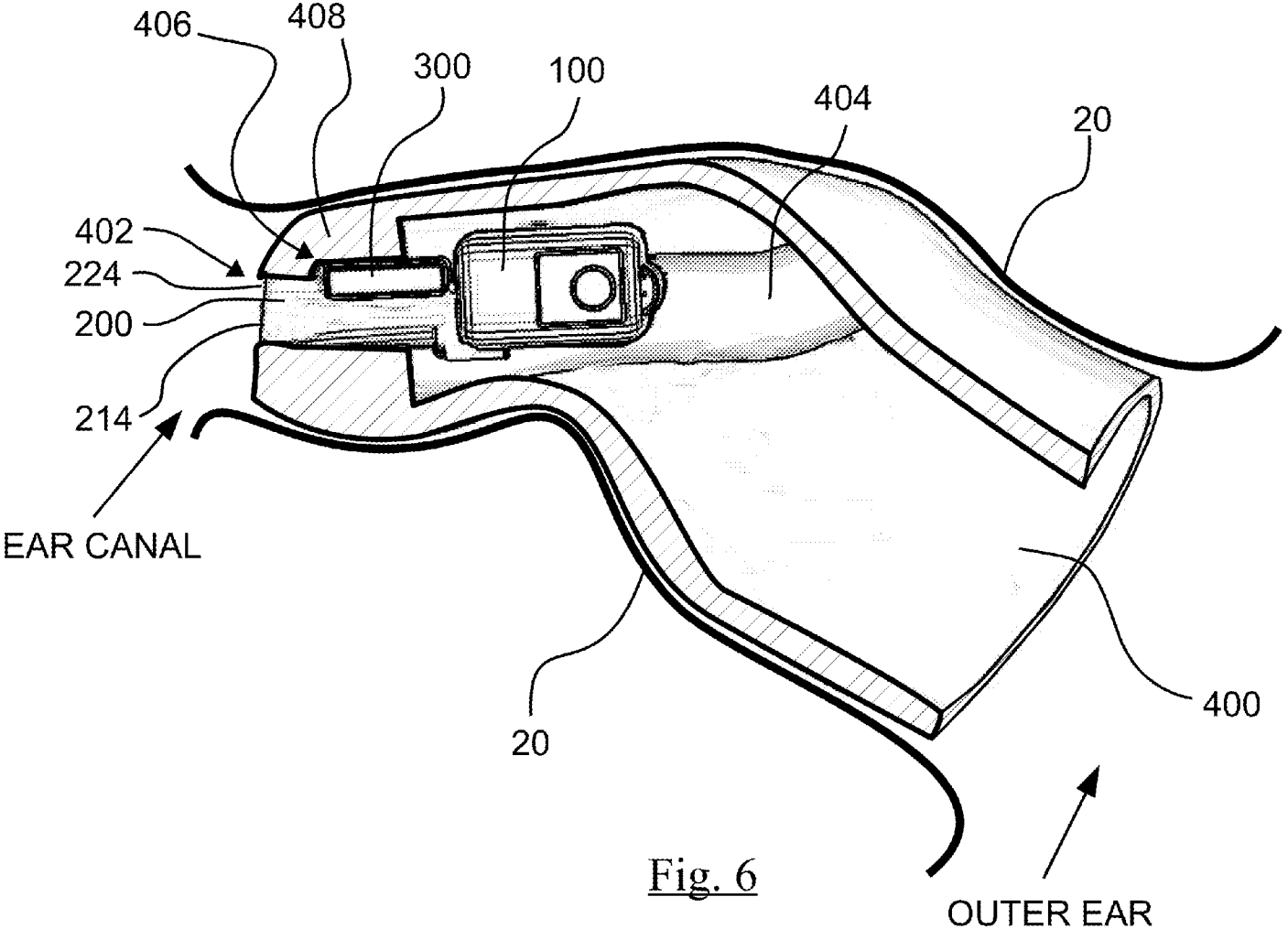
FIG. 6 is a cross-sectional view of a hearing instrument shell positioned in an ear canal, containing the assembly of FIG. 1.

The combined receiver, sound tube, and ear-canal microphone assembly 10 is shown in FIG. 6 in a hearing instrument shell 400 positioned within an ear canal 20 (the relatively-thick lines above and below the shell 400 depict the walls of the user's ear canal 20). The sound tube 200 exits the shell 400 at a receiver hole 402. Also shown is an optional vent 404.

An additional benefit of the combined receiver and microphone assembly 10 is realized during assembly of the hearing instrument. In FIG. 6, the ear-canal microphone 300 resides in an optional recess 406 in the shell wall 408. When the assembly 10 is inserted into the shell 400, the shell 400 shown in FIG. 6 requires that the ear-canal microphone 300 slip into the recess 406, thus orienting the assembly 10 radially with respect to the sound tube 200.

What is claimed is:

1. A receiver and ear-canal microphone assembly for an in-the-canal hearing instrument, comprising:

a receiver comprising a receiver output port;

an ear-canal microphone comprising an ear-canal input port; and a dual-passage sound tube connected to the ear canal, the sound tube comprising a separate, acoustically isolated receiver passage comprising first and second ends;

a receiver aperture at the first end connected to the receiver output port of the receiver; and a hearing instrument aperture at the second end connected to the ear canal;

a separate, acoustically isolated ear-canal microphone passage comprising first and second ends;

an ear-canal microphone aperture at the first end connected to the ear-canal input port of the ear-canal microphone; and a hearing instrument aperture at the second end connected to the ear canal.

2. A receiver and ear-canal microphone assembly as set forth in claim 1, where the receiver and the ear-canal microphone are arranged in tandem.

3. A receiver and ear-canal microphone assembly as set forth in claim 2, where the sound tube has a generally cylindrical shape and the receiver passage is located beneath the ear-canal microphone passage; and the ear-canal microphone is positioned above the receiver passage.

4. An in-the-canal hearing instrument, comprising:

a shell comprising an interior and a receiver hole in the shell connected to the ear canal; and a receiver and ear-canal microphone assembly within the interior of the shell, comprising a receiver comprising a receiver output port;

an ear-canal microphone comprising an ear-canal input port; and a dual-passage sound tube connected to the receiver hole, the sound tube comprising a separate, acoustically isolated receiver passage comprising first and second ends;

a receiver aperture at the first end connected to the receiver output port of the receiver; and a hearing instrument aperture at the second end connected to the receiver hole:

a separate, acoustically isolated ear-canal microphone passage comprising first and second ends;

an ear-canal microphone aperture at the first end connected to the ear-canal input port of the ear-canal microphone; and a hearing instrument aperture at the second end connected to the receiver hole.

5. An in-the-canal hearing instrument as set forth in claim 4, where the interior of the shell comprises a recess that conforms to the ear-canal microphone.

6. An in-the-canal hearing instrument as set forth in claim 4, where the receiver and the ear-canal microphone are arranged in tandem.

* * * * *